United States Patent [19]

Munk

[11] 4,065,898

[45] Jan. 3, 1978

[54] KNOCK-DOWN PARTITION WALL SYSTEM

[75] Inventor: Edmund Munk, Oberstenfeld, Germany

[73] Assignee: Furnier-und Sperrholzwerk J. F. Werz Jr. KG Werzalit Pressholzwerk, Oberstenfeld, Germany

[21] Appl. No.: 579,143

[22] Filed: May 20, 1975

[30] Foreign Application Priority Data

June 10, 1974 Germany ..... 2427997

[51] Int. Cl.[2] ..... E04H 1/00

[52] U.S. Cl. ..... 52/241; 52/275; 52/404

[58] Field of Search ..... 52/238, 593, 580, 620, 52/615, 241, 270, 275, 582, 280, 284, 404

[56] References Cited

U.S. PATENT DOCUMENTS

| | | | |
|---|---|---|---|
| 3,180,457 | 4/1965 | Bohnsack | 52/582 X |
| 3,412,513 | 11/1968 | Gosele | 52/615 X |
| 3,604,168 | 9/1941 | Meineke | 52/238 X |
| 3,861,103 | 1/1975 | Rasmussen | 52/241 |

FOREIGN PATENT DOCUMENTS

| | | | |
|---|---|---|---|
| 1,271,214 | 7/1961 | France | 52/238 |
| 502,559 | 11/1954 | Italy | 52/238 |
| 853,216 | 11/1960 | United Kingdom | 52/238 |

*Primary Examiner*—Price C. Faw, Jr.
*Assistant Examiner*—Carl D. Friedman
*Attorney, Agent, or Firm*—Michael J. Striker

[57] ABSTRACT

The wall system has various wall elements which can be erected and taken down, to create various kinds of partition walls. Each wall element is composed of two parallel but spaced particle-board panels which are connected and have interposed between a sound-absorbent and heat-retardant material.

20 Claims, 11 Drawing Figures

FIG. 1
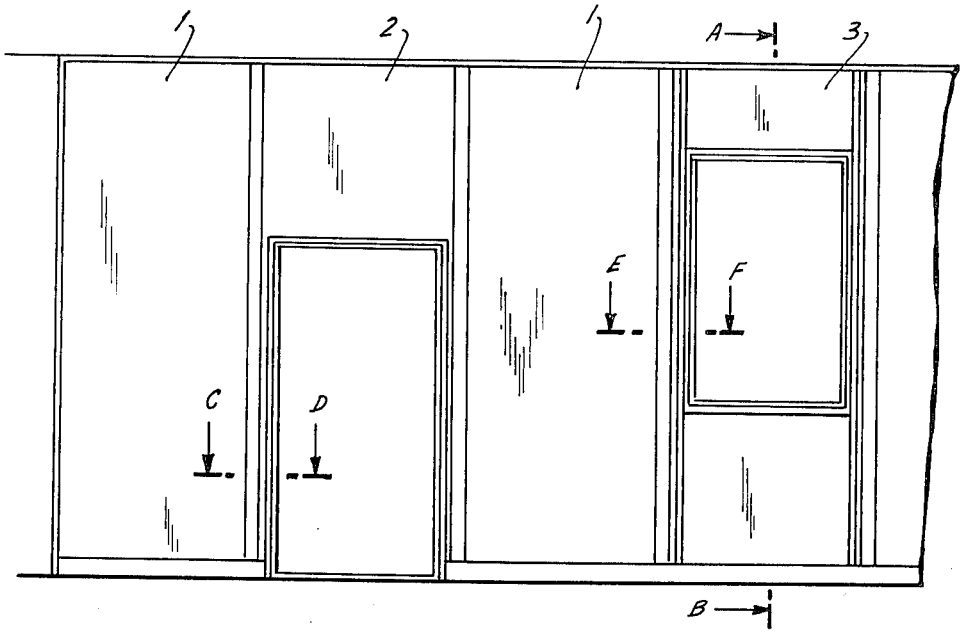
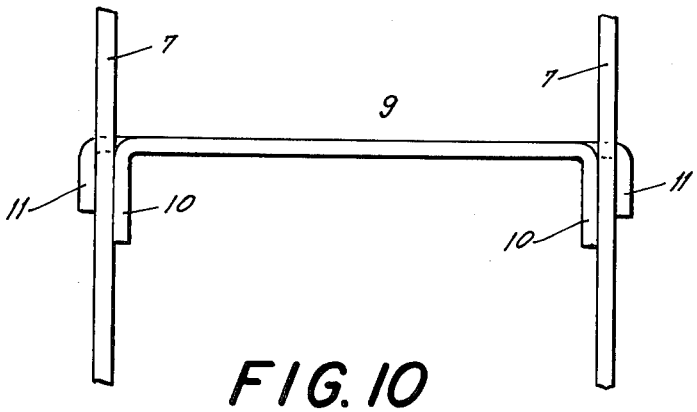
FIG. 10
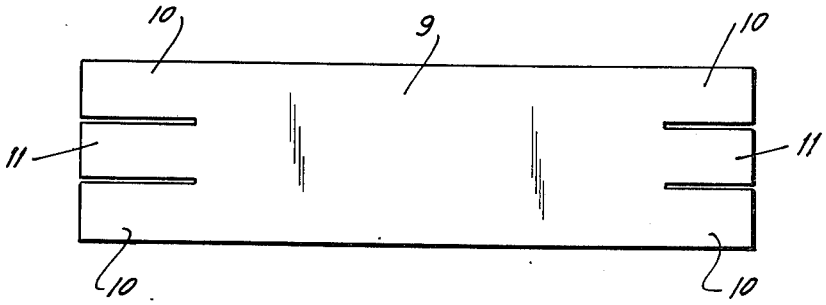
FIG. 11

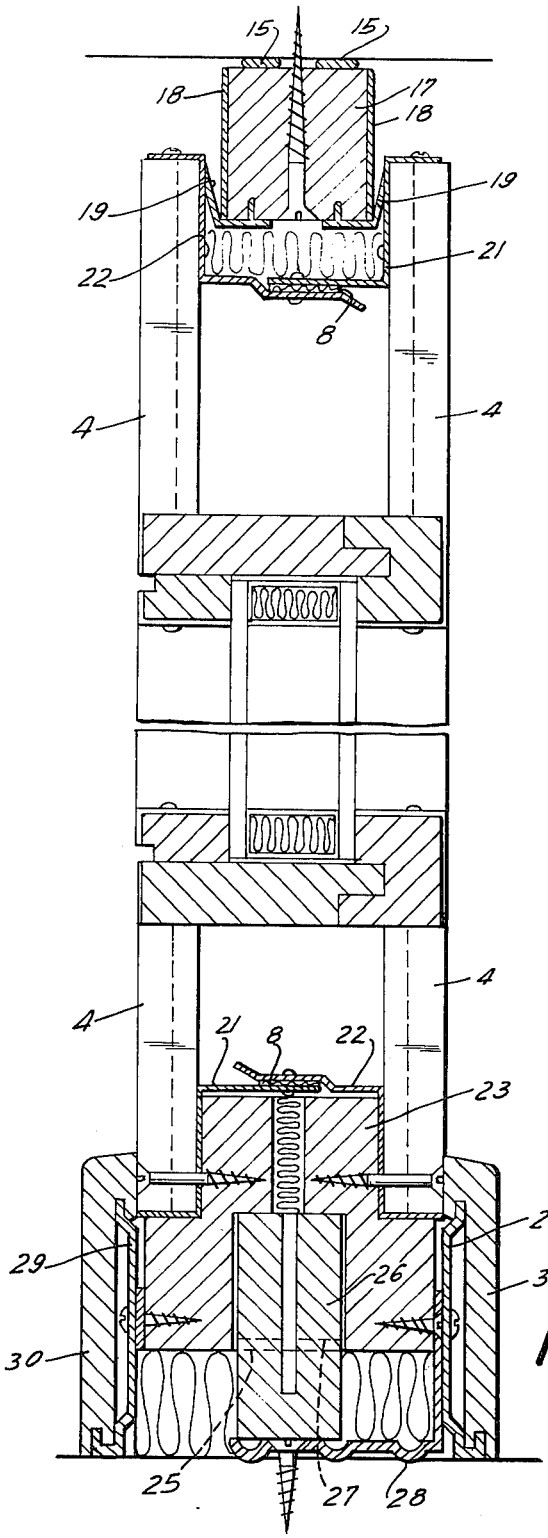
FIG. 3
FIG. 4
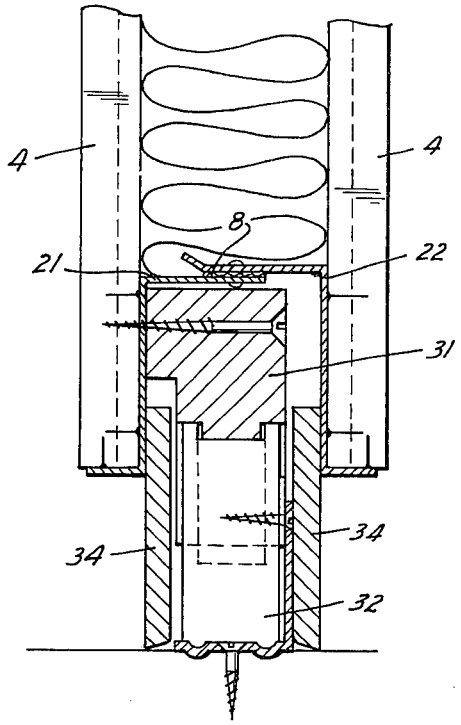

KNOCK-DOWN PARTITION WALL SYSTEM

BACKGROUND OF THE INVENTION

This invention relates to a knock-down partition wall system.

The purpose of such wall systems is primarily to subdivide large spaces into smaller spaces. As it is very often desired to be able to change the size and/or shape of the smaller spaces from time to time, such a wall system must be of the knock-down type, i.e., it must be capable of being assembled at will, disassembled and reassembled in any desired different manner, also at will.

SUMMARY OF THE INVENTION

It is an object of the invention to provide an improved wall system of the type under discussion.

More particularly, it is an object of the invention to provide such a wall system wherein the individual elements of the system are of light weight and can, therefore, be readily and conveniently handled.

Another object is to provide such a system wherein the individual elements can be readily installed, removed and/or exchanged for others in an erected partition wall.

Still a further object of the invention is to provide such a wall system which is inexpensive to produce and which utilizes, to the maximum extent possible, commercially available components in order to further reduce the expense.

A concomitant object is to provide such a system wherein the exposed surfaces of the wall elements in the system are largely maintenance free.

An additional object of the invention is to provide such a system which has acoustically damping capabilities and which meets applicable fire-retardation standards, such as those laid down in German Industrial Standard DIN 4102 for fire resistance class F.

In keeping with these objects, and others which will become apparent hereafter, the invention resides in a knock-down partition wall system which, briefly stated, comprises a plurality of wall elements, each having two transversely spaced profiled particle-board panels, sliver of acoustically and thermally damping material confined between said panels, sheet-material connecting members mounted on each panel adjacent the respective edge portions thereof and extending toward the other panel, the sheet-material members of the respective panels having portions overlapping one another intermediate the panels and being fixedly connected to one another, and at least one element of acoustically and thermally damping material interposed between said overlapping portions; and securing means for releasably securing said panels to the boundary walls bounding a space which is to be partitioned.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a fragmentary elevational view showing a wall erected with the novel system;

FIG. 3 is a vertical section through a wall element taken on line A–B of FIG. 1;

FIG. 4 is a fragmentary vertical section analogous to that of FIG. 3, but showing a different way of connecting a wall element to a floor;

FIG. 10 is a side view of a spacer structure; and

FIG. 11 is a top-plan view of the spacer structure of FIG. 10, but prior to shaping of the structure to the configuration in FIG. 10.

DESCRIPTION OF THE PREFERRED EMBODIMENTS

FIG. 1 shows a portion of a partition wall erected with the novel system of the present invention. This wall is composed of a plurality of wall elements 1 (only one shown), a door element 2 and a window element 3. Each of these elements has the same width as all the others, so that each element may be substituted for every other element in order, for example, to provide a wall with a door where there previously was none, or to close up a previously existing door opening.

Figure 2:
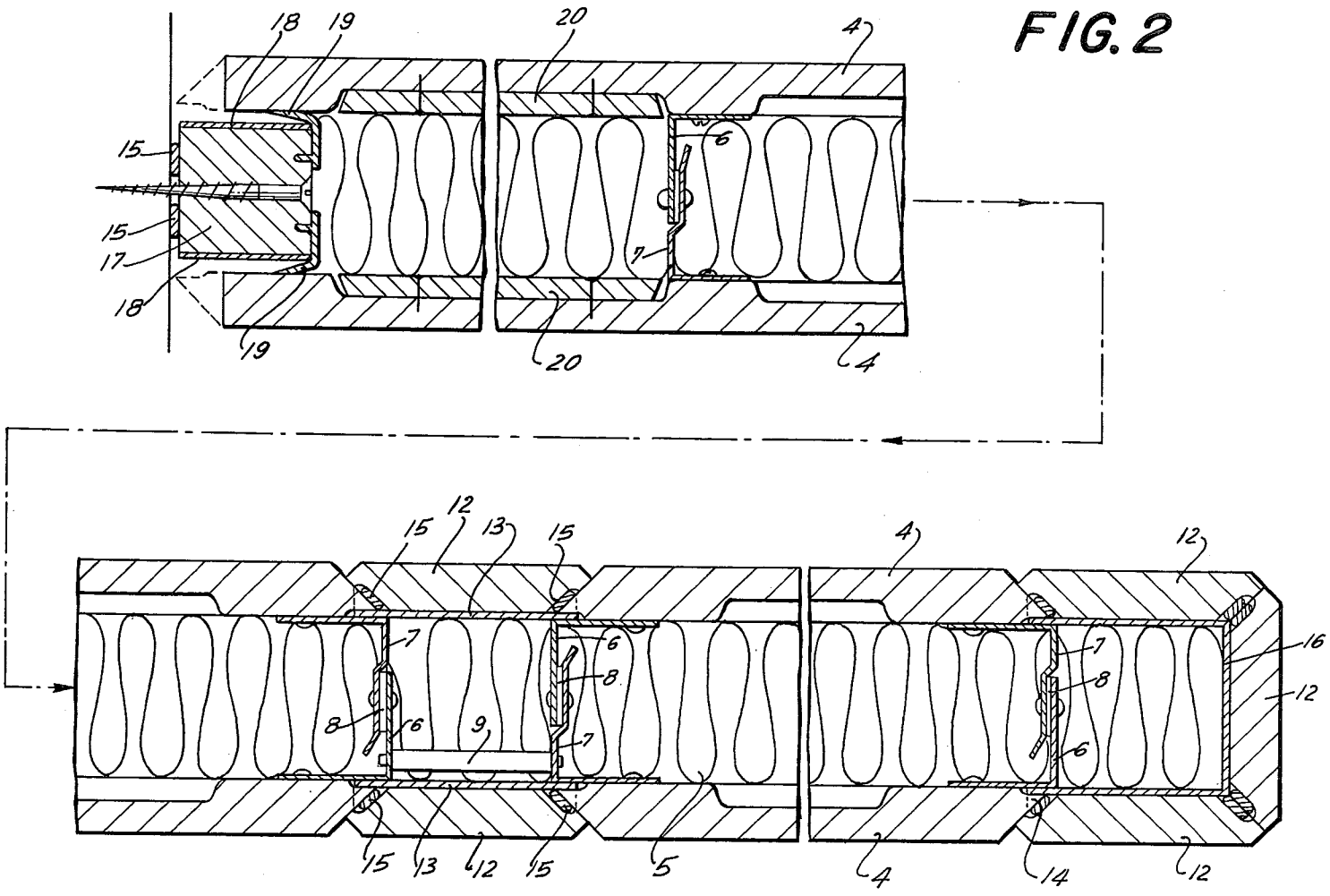
FIG. 2 is a horizontal section through several connected wall elements of the novel system.

FIG. 2—as well as others—shows clearly that each of the elements 1, 2 and 3 (which are hereafter for convenience sometimes generally called "wall elements") has two spaced parallel panels 4 of the particle board, i.e., panels which are molded of one piece from a non-rising mixture of fibrous material and binder material under application of heat and pressure, e.g., as disclosed in German patent application P 23 39 796.8-25.

It is known from that application that members, such as the panels 4, may be made by cold pressing a non-rising mixture of fibrous material (e.g., wood chips) and binder material such as synthetic resin, and that they are thereafter hot pressed to their final shape, the binder material becoming hardened during the hot pressing.

During the hot pressing operation, a decorative foil placed upon a surface of the cold pressed member in the mold, e.g., a foil of melamine resin, can be bonded to this surface to provide a decorative, low-maintenance exposed coating. In fact, all surfaces of the member can be coated in this manner. Thus produced elements are already in use as wall cladding elements, etc., as described in the article "Bretter mit Kunststoffhaut" in "Hobby, Das Magazin der Technik", No. 4/1968, published by EHAPA-Verlag GmbH in Stuttgart, Germany.

The non-rising mixture of which such elements are made is usually composed of lignocellulose containing fibrous materials, such as dried wood chips, sugar cane fibers, or the like. The binder is a synthetic plastic resin which is thermally settable, e.g., melamine resin, urea formaldehyde resin or phenol formaldehyde resin. The fibrous materials may also be composed of or mixed with glass fibers, rock wool or asbestos fibers, with the addition of appropriate organic binders. However, the manufacture and specific composition of these elements is known and not a part of this invention.

FIG. 2 shows in detail the basic construction of the elements 1, 2 and 3 of the present invention.

Each of the elements in FIG. 2, for example a plurality of connected elements 1, is composed of two transversely spaced parallel panels 4 having longitudinal edges which in the illustrated embodiment are beveled at an acute angle. These panels 4 are particle-board, i.e., produced as described above. Located between the panels 4, in the space formed by them, is a mat or sliver 5 of a material—such as asbestos fibers or rock wool—which has fire-retarding and/or acoustically-damping properties. Instead of being fire retarding, the material may also be thermally insulating. The same types of fibers could be used in that case. The precise distance between the panels 4, and the connection between them, is obtained by the right-angled sheet metal members 6, 7 which overlap one another intermediate the two connected panels 4. Where they are overlapped, one or more strips 8 of an acoustically and/or thermally insulating material are placed between them and they are then riveted together or otherwise secured, for example by means of bolts or screws. The sheet material connecting members 6, 7 are first secured to the inwardly facing surfaces of the panels 4, e.g., by means of screws before their overlapping portions are connected together. There is thus obtained a basic wall element which can be assembled in a very simple manner and which, due to the presence of the mat 5 and of the strip or strips 8, assures the existence of a very efficacious acoustic and thermal barrier between the two outer surfaces of the respective element 5.

The outer surfaces of each panel 4, incidentally, are smooth as is shown in FIG. 2, whereas the inner surfaces which face towards one another are formed with reinforcing ribs which advantageously extend parallel to the longitudinal edges of the panels 4. The reinforcing ribs, of course, provide mechanical advantages in terms of reinforcing the respective panel 4; in addition, however, they prevent the respective panel 4 from having a specific resonant frequency and thus further enhance the acoustically damping characteristics of the entire respective wall element. It will be appreciated that between the connecting members 6 and 7 and the respective panels 4, one or more layers of strips of paper, carboard, asbestos or the like, may be incorporated in order to further improve the sound-damping characteristics. When the wall elements are in unconnected condition, for example during storage or transportation, the presence of the connecting members 6 and 7 also serves to protect the edges of the panels.

Adjacent ones of the wall elements are connected at their longitudinal edges when a partition wall is to be erected, as in FIG. 1. The connection can be effected in one of two ways. According to one way, a plurality of spacing members 9 is provided which is distributed over the length of the longitudinal edges of the respective wall elements, and one of which is shown in FIG. 11 in an unshaped condition. According to FIG. 11, each of the spacing elements 9 is in form of a narrow strip of sheet metal having ends which are provided with two incisions so as to be partitioned into three fingers each. The outer fingers 10 are bent at right angles and thereupon the middle finger is pushed through slots provided in the connecting members 6 and 7 and is also bent over. The finished condition of the spacing member 9 is shown in FIG. 10. It will be appreciated that this bending over is effected at each end of the spacing member 9, each end being associated with a different one of the wall elements 1, 2 or 3. Of course, it is also possible to pre-bend the member 9 from the condition shown in FIG. 11 to the condition shown in FIG. 10, and then to establish the connection between adjacent wall elements in the manner described before.

The second measure which can be taken according to the invention for connecting adjacent wall elements is combined with the measures taken for covering the juncture between two connected wall elements. For this purpose, profiled cross section strips 12 are provided with advantageously are produced in the same manner as the panels 4 themselves. Mounted on the reverse side of the members 12, distributed over their length, is a plurality of holding members 13 of sheet metal which are connected to the members 12 by screws and whose ends extend into narrow depressions between the edges of the panels 4 and the connecting members 6, 7. Numeral 14 shows that longitudinal edges of the panels 4 are provided with recesses in keeping with the spacing of the members 13. The members 12 provided with the members 13 are placed from the side against the juncture between adjacent wall elements in such a manner that the ends of the members 13 extend into the aforementioned recesses 14. Thereupon the entire member 12 is pushed downwardly (i.e., in FIG. 2, in direction normal to the plane of the drawing and away from the viewer), so that the ends of the members 13 move behind the longitudinal edges of the panels 4 where, if desired, they may also be made to snap or resiliently slide behind lugs provided on the members 6, 7. The longitudinal edges of the members 12 are also provided with recesses into which sealing strips, profiled seals 15 or the like, may be inserted.

FIG. 2 shows at the right-hand end thereof a terminal, i.e., a manner of terminating a partition wall erected with the wall elements of the invention, in such a manner that there will be a neat edge provided. For this purpose, three profiled strip members 12 are provided which are screwed to U-shaped sheet metal members 16 and thus form in effect a U-shaped cap. They are then connected with the adjacent edge portion of a respective wall element in the manner described above with respect to the connection of the profiled members 12.

The space between adjacent connected wall elements 1, 2 or 3, which is covered by the profiled members 12, may also serve as a channel in which various components such as electrical wires or the like can be run. In such a case, the profiled members 12 may have electrical outlets, switches or the like mounted on them and these may then be connected with the electrical wires which are concealed behind the profiled members 12. The members 9 may then be provided with clamping elements which clampingly retain the electrical conductors.

The left-hand end of FIG. 2 shows how a wall element (and in FIG. 2, of course, the entire wall composed of a plurality of wall elements) is connected to a boundary wall bounding a space which the partition wall is used to subdivide. For this purpose, a beam 17 is mounted on the boundary wall, for example by means of screws as shown, elastically yieldable sealing strips 15 being interposed. The exposed surfaces of the beam 17 are preferably provided with flame-retardant coatings 18 which are commercially available and are not a part of the present invention, as to their composition. The surface of the beam 17 which faces inwardly of the space between the panels 4 of an adjacent wall element has recessed in it elongated synthetic plastic material members 19 which are of profiled cross section and which serve to engage the panels 4 and provide a seal with respect to the same. In the region of this connection the recesses at the inwardly facing sides of the panels 4 are advantageously filled with plates 20 to provide a planar inner surface for the panels 4 which has the advantage, as shown in FIG. 2, that the wall element will always be able to properly cooperate with the beam 17 and the members 19 irrespective of whether or not it has been trimmed in its width.

FIG. 3 shows in its upper portion that the manner in which the wall elements are connected to the sealing, i.e., to the sealing part of the boundary wall bounding a space which the partition wall is to subdivide, is analogous to the manner in which the wall elements are to be connected to a side wall. Like reference numerals identify like components and the construction will be self-explanatory. The only difference is that right-angle elongated profile members 21 and 22 are provided for the sealing connection and also for the floor connection (compare the lower end of FIG. 3) which almost completely overlaps the narrow edges of the panels 4. The connection of the wall elements to the floor can be carried out in one of two ways according to the invention. One way is shown in FIG. 3 where wooden members 23 of profiled cross section are inserted between the lower edges of the panels 4, with spacing from one another, and are connected by means of screws to these lower edges. The members 23 have a cross section resembling two rectangles which are laterally offset relative to one another. The edge 24 formed by the two members 23 extends at a downward inclination at the opposite ends of the wall elements, approximately to the level indicated by reference numeral 25. The upper edge of a U-profiled member 26, also of wood, extends inwardly and downwardly to the level identified by reference numeral 27. This construction makes it possible, by shifting the members 26 to horizontally orient the wall element and to raise or lower it and thus set it for the desired position and orientation. The final connection of the wall element to the floor is effected after the positioning, by screwing the member 23 to a metallic angle bracket 28 which, in turn, is screwed to the floor. The arm of this angle bracket 28 which is in contact with the floor is advantageously provided with waves or projections, so that it will be in proper contact with the floor even though it may rest on a carpet that is interposed between it and the floor, and will yet prevent the travel of sound through and underneath the bracket 28.

After the connection to the floor has been carried out, the juncture of the wall element with the floor can be covered by screwing a metal base plate or base boards 29, which are commercially available, against the members 23, and placing space board strips 30 of wood or other material onto the members 29.

A second way of connecting the wall elements 1, 2 or 3 to the floor is shown in FIG. 4. The arrangement of FIG. 4 requires less space than that required in FIG. 3. In FIG. 4, only a single elongated wooden member 31 of profiled cross section is connected by screws to one of the panels 4 of the respective element. Analogous to the ends of the profiled members 23 of FIG. 3, the ends of the member 31 are inclined as wedge-shaped ramps, and at each opposite end of the element 1, 2 or 3 there are provided two wedge-shaped members 32 which are inserted from these opposite ends and whose purpose is the same as that of the member 26 in FIG. 3, i.e., to raise and lower the element. The final connection of the element to the floor is analogous to the manner discussed with reference to FIG. 3, in that an angled profile 33 of L-shaped cross section is utilized which is connected by screws to the member 32 and to the floor. Strips 34 are inserted between the member 33 and the lower edge of the outwardly facing one of the panels 4, to cover the juncture between the element and the floor.

Figure 5:
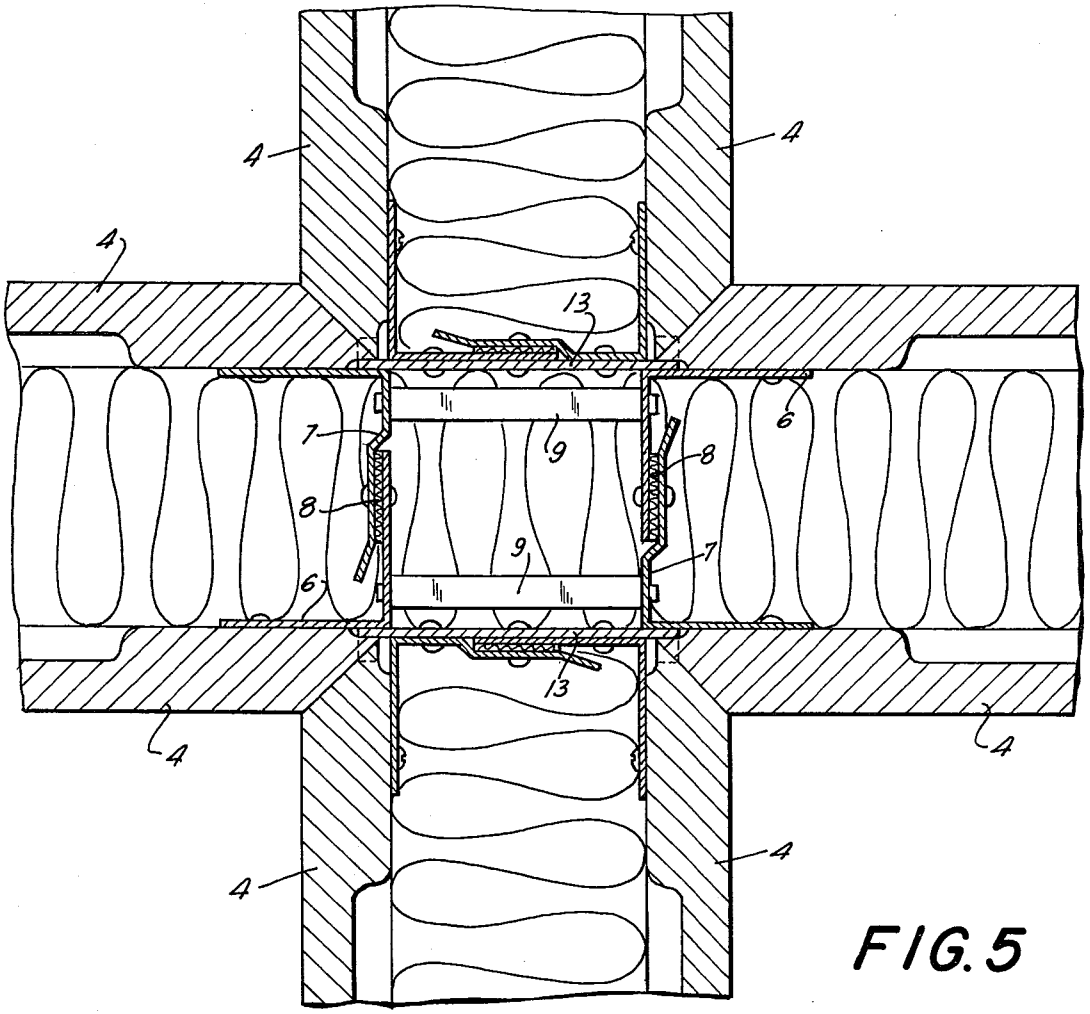
FIG. 5 is a horizontal section through four wall elements which are connected in the manner of a cross.

In FIG. 5 I have illustrated a manner of connecting four of the elements 1, 2 or 3 which meet at their corners in the manner of a cross-shaped juncture. The connection of two of the elements 1, 2 or 3 is effected by means of the spacing members 9 in the manner described with respect to FIG. 2. The other two elements have members 13 threadedly or by means of rivets connected to them, namely onto the members 6 and 7, and the members 13 engage cooperating members, such as the members 12 in FIG. 2.

Figure 6:
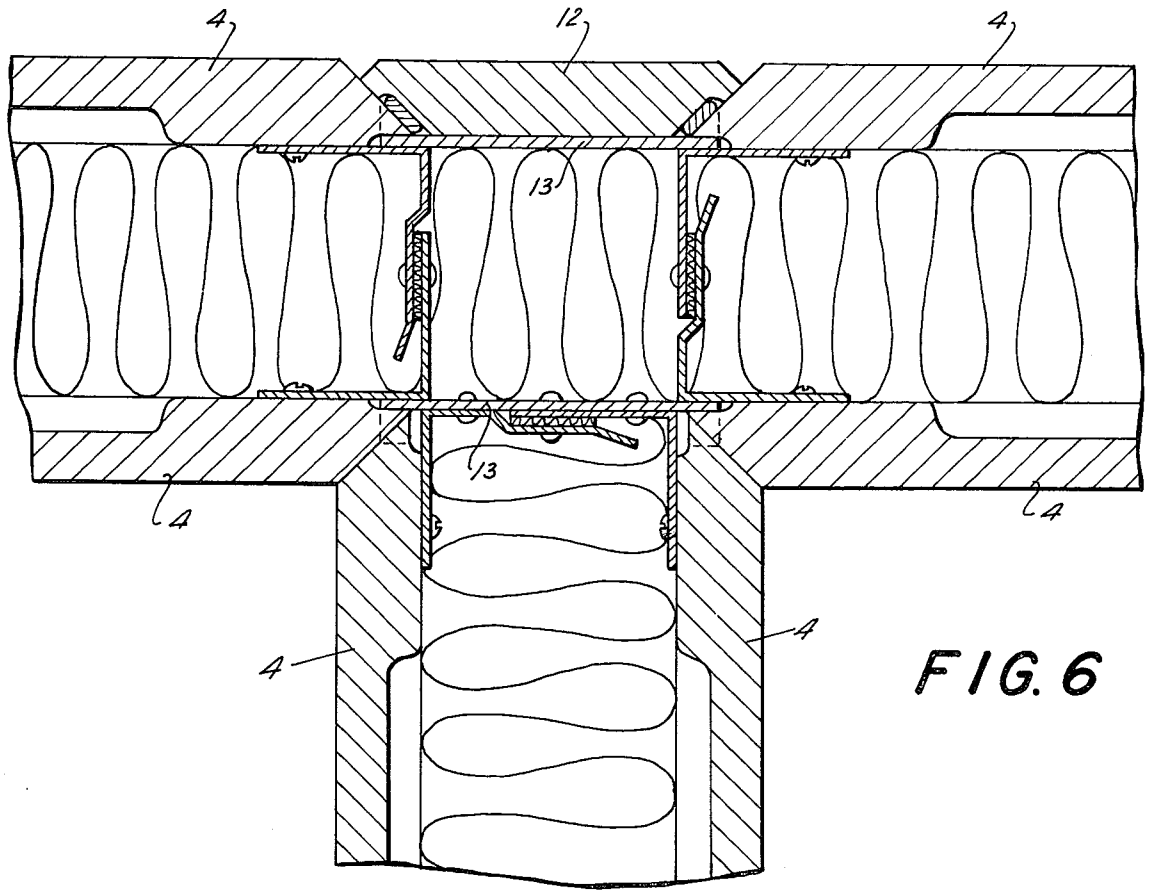
FIG. 6 is a view similar to FIG. 5, but showing three wall elements connected in the shape of a letter T.

FIG. 6 shows how wall elements 1, 2 or 3 can be connected so that they join in the manner of a letter T. Again, the longitudinal edges of these three wall elements are connected, and the connection is in the form shown in FIG. 5 except that the fourth of the elements shown in FIG. 5 is replaced in FIG. 6 by one of the profiled strip members 12.

Figure 7:
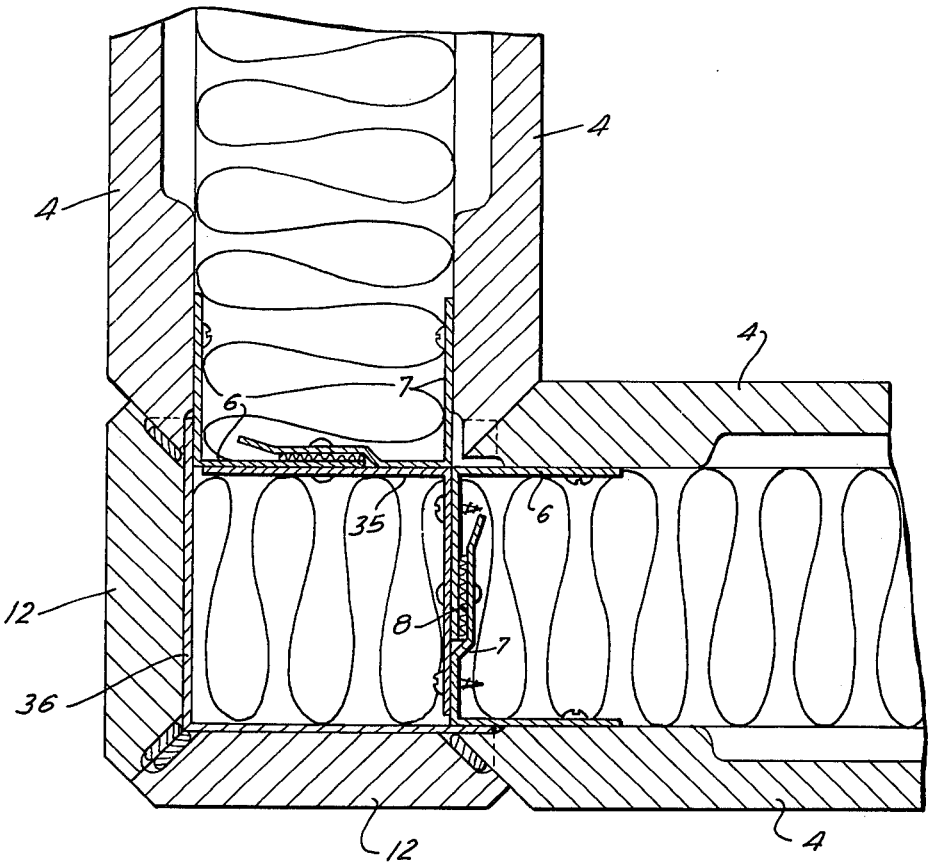
FIG. 7 is a view similar to FIG. 6, but showing two wall elements connected at their corners so as to extend at right angles to one another.

FIG. 7 shows a connection between two of the wall elements when they are connected along their longitudinal edges and extend at right angles to one another. In this type of connection, a right-angular connecting member 35 is connected by screws or rivets to the connecting members 6 and 7. This connection is then covered by two of the profiled strip members 12 which are threaded to the member 36 and are hooked to the wall elements in the manner described with reference to FIG. 2.

Figure 8:
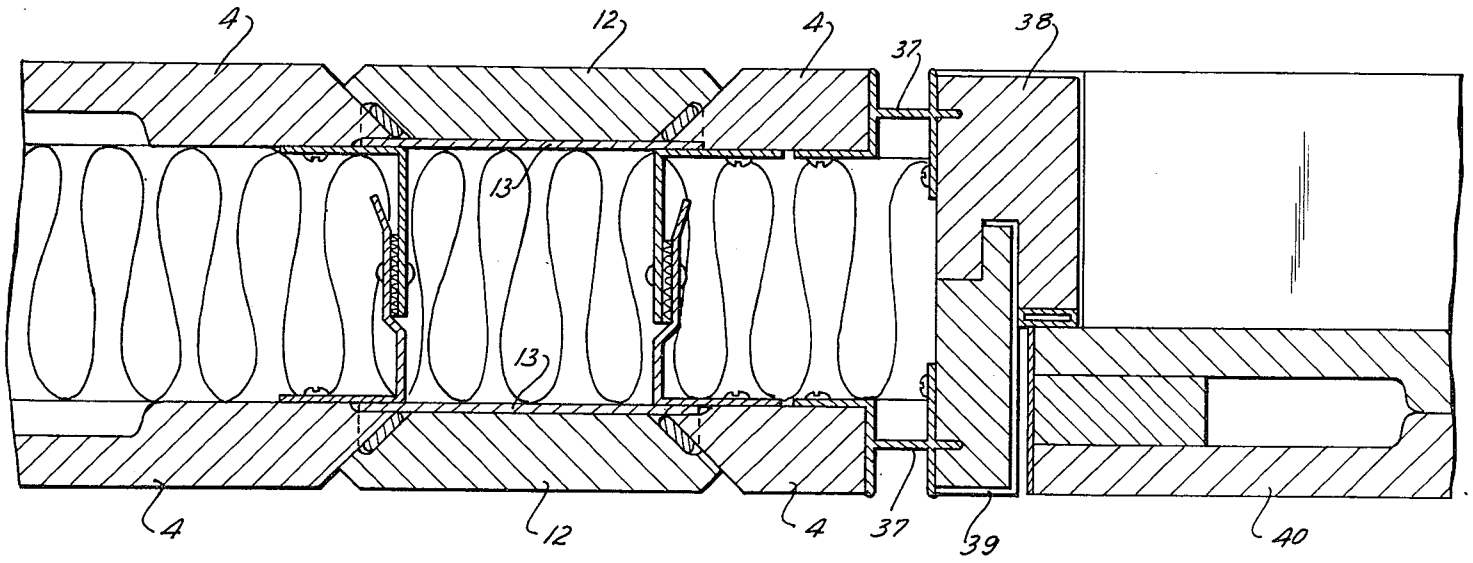
FIG. 8 is a section taken on line C–D of FIG. 1.

In conjunction with FIG. 1, it has already been explained that the wall elements may be simply planar wall elements, or may be door elements or window elements, being generically called "wall elements" throughout this specification and the appended claims. FIG. 8 shows by way of example a door element, i.e., the element 2 shown in FIG. 1. The construction of a door element 2 is the same as that of a wall element 1, except that an opening corresponding to the desired door opening is cutout or otherwise formed in the panels 4. Thereafter, a frame portion 38 is mounted on one of the panels 4 by means of a metal bracket 37; the frame portion 38 may be wood or any other suitable material, such as synthetic plastic, press board or the like. In a corresponding manner, the other panel 4 has the frame 39 secured to it. The profiled cross section of the frame portions 38 and 39 is so selected that they can be pushed together and will then be connected and form a doorstop. The door 40 can then be mounted on the thus produced door element 2.

Figure 9:
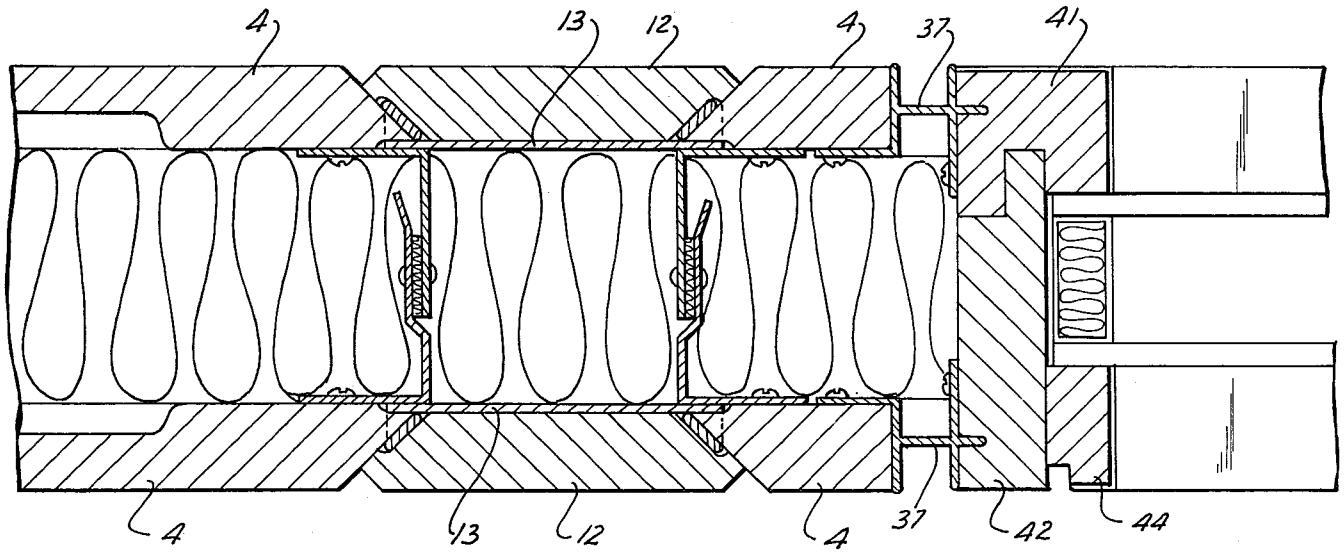
FIG. 9 is a section taken on line E–F of FIG. 1.

Finally, FIG. 9 shows how a window element 3 (compare FIG. 1) can be constructed in accordance with the present invention. Again, it will be seen that the window element 3 is constructed in an analogous manner as the door element 2 in FIG. 8. The difference between the two is that the frame members 41 and 42 of the window frame have different dimensions than the frame members 38 and 39 of the door frame. The frame members 41 and 42 together form a window frame into which a window pane of glass or synthetic plastic material may be inserted and which is then fixed in its position by a retaining frame 44 that is connected to the frame composed of the frame members 41 and 42.

It will be clear from the description herebefore that the present invention makes it possible to provide a knock-down wall system which affords manifold opportunities for erecting, disassembling and quickly changing partition walls of all different types. In addition, the construction of the wall elements for the system of the present invention is simple and inexpensive, the wall elements are light in weight, and they afford the desired acoustic damping effect and thermal insulation or fire retardation. Moreover, the various elements can be rapidly and in a very simple manner assembled and disassembled so that their usage is greatly facilitated. In addition, only a comparatively small number of different components is necessary in the system of the present invention, and this further facilitates the use of the system and reduces its expense.

It will be understood that each of the elements described above, or two or more together, may also find a useful application in other types of constructions differing from the type described above.

While the invention has been illustrated and described as embodied in a knock-down partition wall system, it is not intended to be limited to the details shown since various modifications and structural changes may be made without departing in any way from the spirit of the present invention.

Without further analysis, the foregoing will so fully describe the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A knock-down partition wall system, comprising a plurality of wall elements, each having two transversely spaced profiled particle board panels, a sliver of acoustically and thermally damping material confined between said panels, sheet-material connecting members mounted on each panel adjacent respective edge portions thereof and extending towards the other panel, the connecting members of the respective panels having portions overlapping one another intermediate the panels and being fixedly connected to one another, spacing elements extending between said connecting members and having at each end bent portions engaging respective ones of said connecting members so as to provide a predetermined space between adjacent wall elements, means for bridging said space and including holding members having engaging portions hooked onto said edge portions of said panels; and securing means for releasably securing said panels to the boundary walls bounding a space which is to be partitioned.

2. A wall system as defined in claim 1 wherein said edge portions of said panels are provided at their inner surfaces with recesses arranged to receive said engaging portions of said holding members.

3. A wall system as defined in claim 1, wherein at least one element of acoustically and thermally damping material is interposed between said overlapping portions of said connecting members.

4. A wall system as defined in claim 1, wherein each of said connecting members has a slot, each of said portions of said spacing member are constituted by three adjacent fingers a middle one of said fingers is bent and pushed through said slot of a respective connecting member so as to abut on the outer surfaces of said connecting members, two outer fingers of said spacing members are bent so as to abut on the inner surfaces of said connecting members.

5. A wall system as defined in claim 1, wherein said panels are each molded in one piece of a non-rising mixture of fibrous matter and binder material.

6. A wall system as defined in claim 1, wherein said edge portions are beveled at an angle of substantially 45°.

7. A wall system as defined in claim 1, wherein said panels each have a pair of vertical and a pair of longitudinal edge portions; and wherein the outwardly directed surfaces of said panels are smooth and the inwardly directed surfaces are formed with reinforcing ribs extending substantially parallel to the edge portions of one of said pairs.

8. A wall system as defined in claim 1, and further comprising cover members bridging the space between said panels.

9. A wall system as defined in claim 1, wherein said cover members are strip-shaped and have longitudinal edges which are beveled at obtuse angles and formed with recesses for the accommodation of sealing strips.

10. A wall system as defined in claim 1; and further comprising terminating means for an end of a partition wall composed of said wall elements, said terminating means comprising a U-shaped structure having three profiled strip members and U-shaped connectors connecting said strip members and engageable with edge portions of respective wall elements.

11. A wall system as defined in claim 1, said securing means comprising beams extending along upwardly facing edges of the respective wall elements, each beam having a side facing inwardly of the space between the panels of the respective wall element, and an elongated synthetic plastic insert recessed into said sides.

12. A wall system as defined in claim 1, said panels each having an inner side formed with depressions, and plate members filling said depressions in the region where th respective wall elements are secured to one of said boundary walls.

13. A wall system as defined in claim 1, said securing means including for each wall element a structure adapted for connection to the floor boundary wall of a space to be partitioned, said structure comprising wood strips connected to edges of the respective panels of the element, insert members of profiled cross-section slidably received between said wood strips, and a metallic angle member connected to said insert members and adapted for connection to the floor boundary wall.

14. A wall system as defined in claim 13, wherein said insert members are of U-shaped cross-section.

15. A wall system as defined in claim 13, wherein said insert members are of wedge-shaped cross-section.

16. A wall system as defined in claim 1, said securing means including for each wall element a structure adapted for connection to the floor boundary wall of a space to be partitioned, said structure comprising an elongated wood member of profiled cross-section, screws connecting said wood member to an edge portion of one of said panels so as to be located between the latter, a pair of wedge-shaped members slidably received beneath said wood member from opposite longitudinal ends thereof, and a metallic angle member connected to said wedge-shaped members and adapted to be connected to said floor boundary wall.

17. A wall system as defined in claim 1, and further comprising releasable retaining means for wall elements which are arranged in form of a cross, including interengaging retaining members mounted on said connecting member, the retaining members of said wall elements having edges which are located opposite one another and are adapted for interengagement.

18. A wall system as defined in claim 1; further comprising an L-shaped retaining member connected to said connecting members, and two connected strip members arranged in L-shaped configuration, overlying said L-shaped retaining member and hooked onto a pair of wall elements which extend at right angles to one another.

19. A wall system as defined in claim 1; further comprising door frame portions bounding a cut-out in each of several of said wall elements, said frame portion together forming a door frame which bounds a door opening when said several wall elements are mounted in requisite relative position.

20. A wall system as defined in claim 1; further comprising window frame portions bounding a cut-out in each of several wall elements, said frame portions together forming a window frame which bounds a window opening when said several wall elements are mounted in requisite relative positions.

* * * * *